US007757386B2

(12) United States Patent
Imgrüt et al.

(10) Patent No.: US 7,757,386 B2
(45) Date of Patent: Jul. 20, 2010

(54) CRIMPING PRESS

(75) Inventors: Peter Imgrüt, Baar (CH); Marc Speck, Zug (CH)

(73) Assignee: Komax Holding AG, Dierikon (CH)

( * ) Notice: Subject to any disclaimer, the term of this patent is extended or adjusted under 35 U.S.C. 154(b) by 848 days.

(21) Appl. No.: 11/531,880

(22) Filed: Sep. 14, 2006

(65) Prior Publication Data

US 2007/0062246 A1 Mar. 22, 2007

(30) Foreign Application Priority Data

Sep. 19, 2005 (EP) ..... 05108631

(51) Int. Cl.
*H01R 43/055* (2006.01)

(52) U.S. Cl. ..... 29/753; 29/759; 29/761; 29/863; 72/426; 72/428

(58) Field of Classification Search ..... 29/33 M, 29/753, 861, 863, 759, 761; 72/420, 421, 72/426, 428

See application file for complete search history.

(56) References Cited

U.S. PATENT DOCUMENTS 4,025,999 A 5/1977 Wolyn et al.

FOREIGN PATENT DOCUMENTS

| | | | |
|---|---|---|---|
| EP | 1029387 B1 | | 8/2000 |
| EP | 1394908 A1 | | 3/2004 |
| FR | 2782578 A | | 2/2000 |
| JP | 10050451 A | * | 2/1998 |

* cited by examiner

*Primary Examiner*—A. Dexter Tugbang
*Assistant Examiner*—Livius R Cazan
(74) *Attorney, Agent, or Firm*—Fraser Clemens Martin & Miller LLC; William J. Clemens

(57) ABSTRACT

A crimping device has a contact advancer provided with an exchangeable anvil part. A first pulley, a belt and an advancing motor drive a first carriage. A gripper for advancing the contact belt is guided in a direction crosswise to a direction of the first carriage. The distance between the gripper and the first carriage is determined by a second carriage and a roller of the gripper rolling in a fifth linear guide of the second carriage. The distance from the gripper is predetermined by the exchangeable anvil part and depends on the width of the contact belt. The gripper operates independent of the distance between the transport holes and independent of the width of the contact belt. The anvil part including the belt guide is an exchangeable part and only fits one type of crimp contact and is executed crimp-contact specifically.

14 Claims, 4 Drawing Sheets

CRIMPING PRESS

BACKGROUND OF THE INVENTION

The present invention relates to a crimping press and a method of fastening belted crimp contacts to wires by means of crimpers and an exchangeable anvil part, a contact advancer advancing a contact belt that carries the crimp contacts as far as the exchangeable anvil part.

There is shown in European patent specification EP 1 029 387 B1 a crimping press by which an electrical contact can be fastened onto the end of a wire. A crimping punch in conjunction with a crimping anvil fastens the crimp contact to the end of the wire. An advancing unit with an advancing element can be moved backward and forward between two stops. With every backward and forward movement of the advancing element, the crimp contact belt is advanced further toward the crimping anvil.

A disadvantage of this crimping press is that when changing to different crimp contacts and different contact distances in the crimp contact belt, the advancing unit must be readjusted. The holes and the hole pattern in the crimp contact belt can also vary according to the supplier.

SUMMARY OF THE INVENTION

It is here that the present invention sets out to provide a remedy. The present invention provides a solution for avoiding the disadvantages of the known device, and creating a device and a method that make changing over to different crimp contacts, or to different contact distances in the contact belt, or to different belt widths, easy.

The advancing device can process contact belts with different contact distances without difficulty. By exchanging the exchangeable part, especially the contact-specific anvil part, the advancing device is automatically adapted to different widths of belt. Advancing of the contact belt by means of the advancing device depends on friction, by means of which the contact belt is gripped and advanced. The exact positioning and fixing of the crimp contacts during the crimping operation takes place in the anvil part by means of pins that engage in transport holes of the contact belt. Thanks to the simple changeover, especially changeover time and setting errors can be avoided, which in turn has a favorable effect on the production costs especially of many small production lots.

In the device according to the present invention, the contact advancer has a gripper that is independent of the distance between the transport holes and the width of the contact belt and that advances the contact belt as far as the exchangeable anvil part, a belt guide being provided on the exchangeable anvil part for fine positioning and holding of the contact belt.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
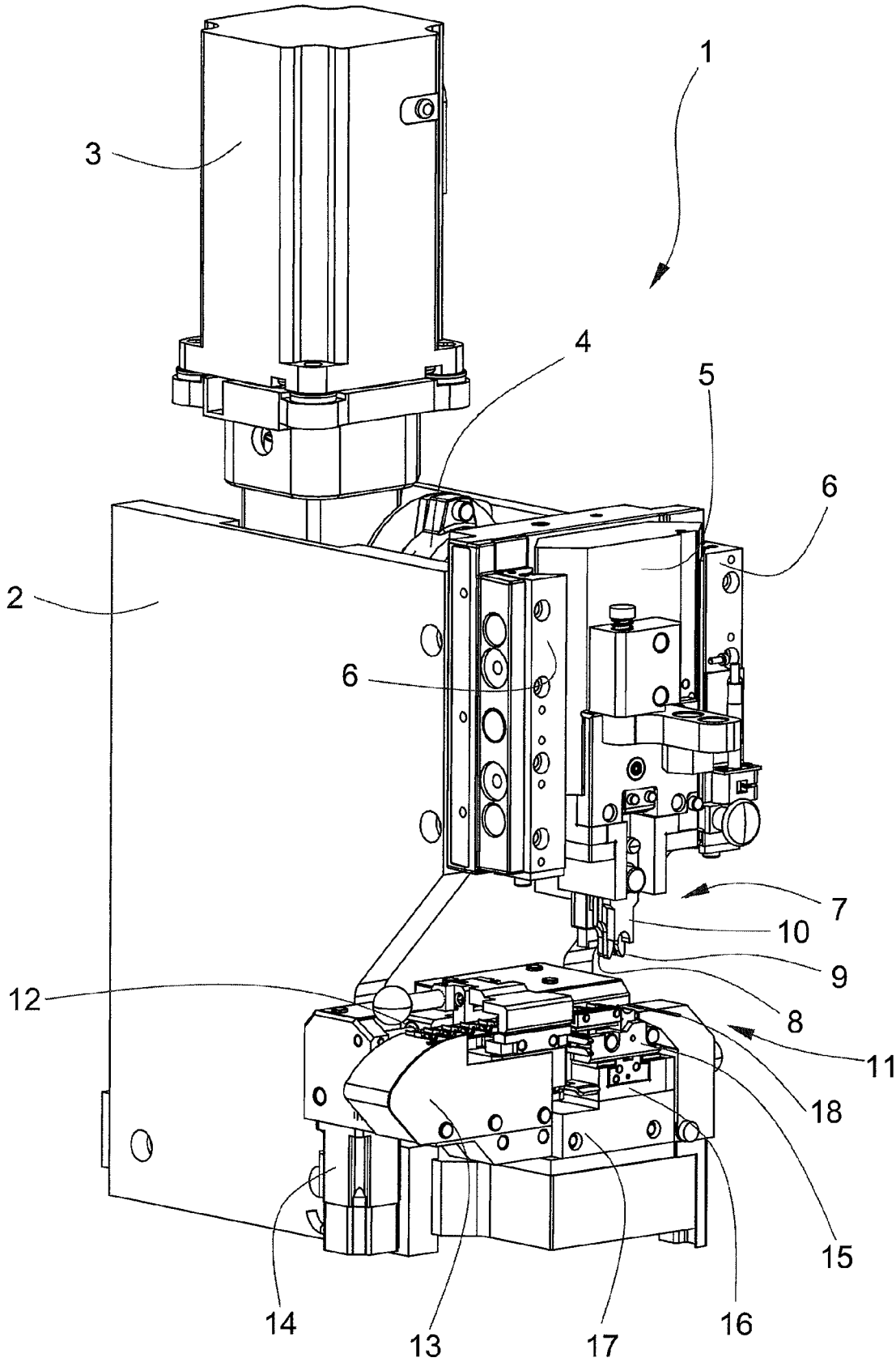
FIG. 1 is a perspective view of a crimping press according to the present invention.

FIG. 1 shows a crimping press 1 according to the present invention comprising a first housing 2 on which a press motor 3 that drives a gear 4 is arranged. Provided on the output side of the gear is an eccentric device that converts the rotational motion of the motor 3 and the gear 4 into a linear up-and-down motion that can be transferred to a press carriage 5, the press carriage 5 being guided by means of guides 6. Provided for the production of a crimped fastening between a crimp contact 19 (FIG. 2) and a wire 18, and arranged on the press carriage 5, is an upper tool 7 with a conductor crimper 8, an insulation crimper 9, and a cutter plunger 10, the upper tool 7 working in conjunction with a lower tool 11. The lower tool 11 comprises an exchangeable part of an anvil 15, a sensor part 16, and a first supporting part 17. The crimp contacts 19 to be processed are parts of a contact belt 12 that is advanced by means of a contact advancer 13. An advancing motor 14 drives the contact advancer 13.

Figure 2:
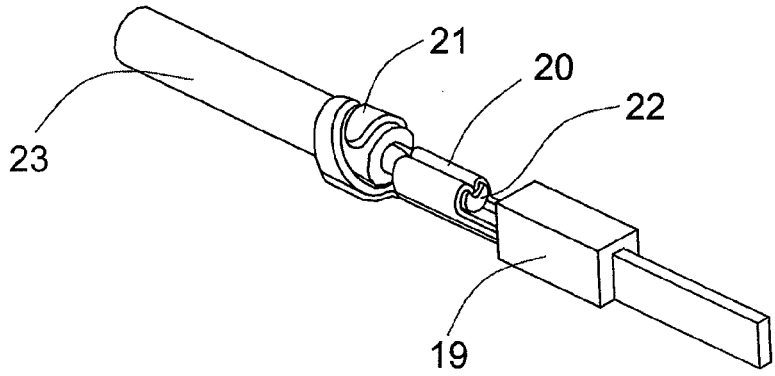
FIG. 2 is a perspective view of a crimp fastening.

FIG. 2 shows a crimp fastening between the wire 18 and the crimped contact 19 with a plastically deformed conductor crimp 20 and a plastically deformed insulation crimp 21. Plastic deformation of the crimps 20, 21 takes place by means of the crimpers 8, 9 and the anvil. The conductor crimp 20 embraces strands of a wire conductor 22, and the insulation crimp 21 embraces a wire insulation 23.

Figure 3:
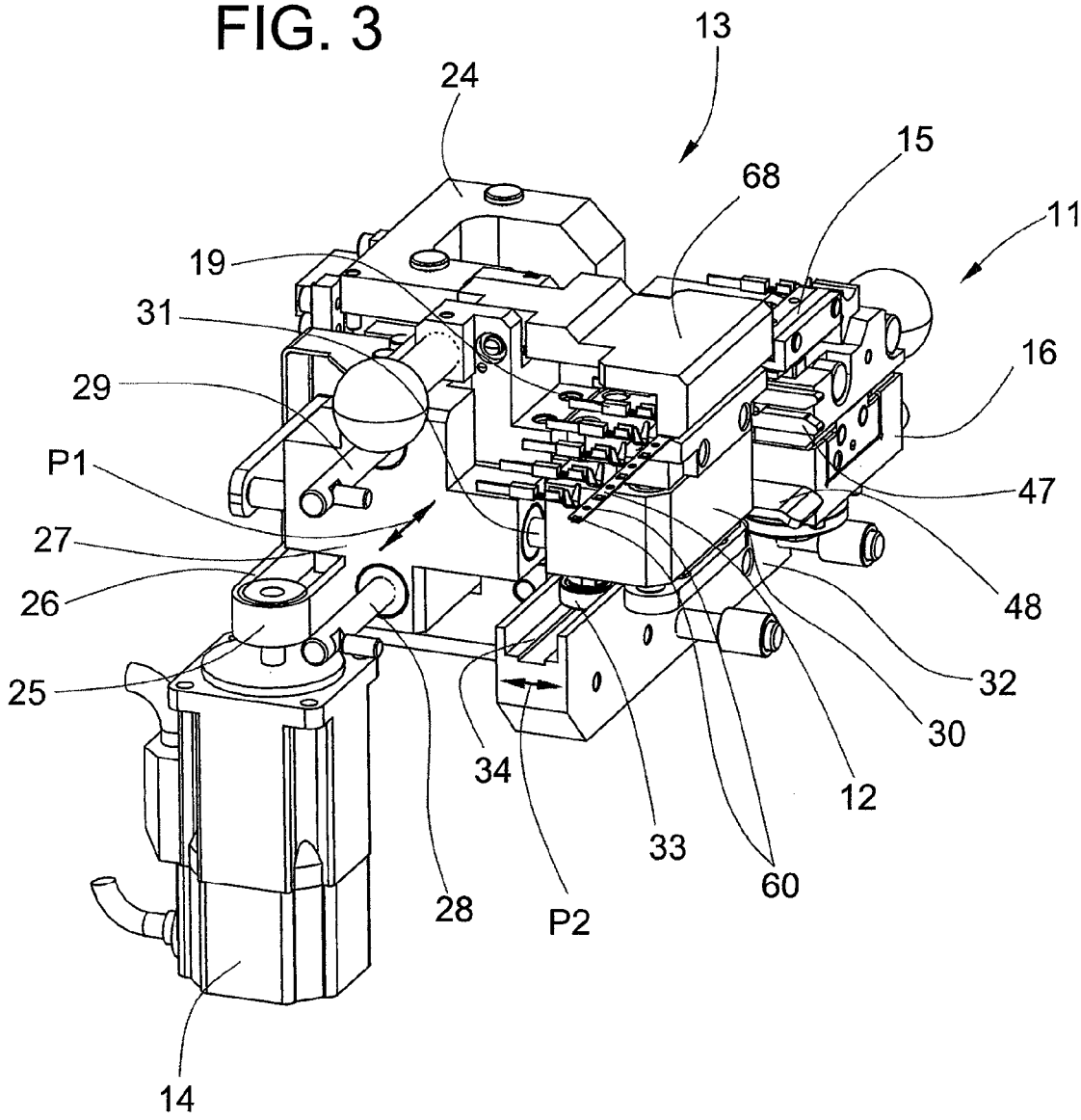
FIG. 3 is an enlarged perspective view of the contact advancer shown in FIG. 1.

FIG. 3 shows the contact advancer 13 that also contains the lower tool 11. The advancing motor 14 is arranged on a housing 24 and by means of a first pulley 25 and a belt 26 drives a first carriage 27 that is guided on a first linear guide 28 and on a second linear guide 29. The motion of the carriage 27 is indicated by a first arrow P1. A gripper 30 for advancing the contact belt 12 is guided by means of a third linear guide 31 and a fourth linear guide 63 (FIG. 4) in crosswise direction as indicated by a second arrow P2. The distance between the gripper 30 and the first carriage 27 is determined by a second carriage 32, a roller 33 of the gripper 30 rolling in a fifth linear guide 34 of the second carriage 32. The distance from the gripper 30 is predetermined by the exchangeable anvil part 15 and depends on the width of the contact belt 12.

Figure 4:
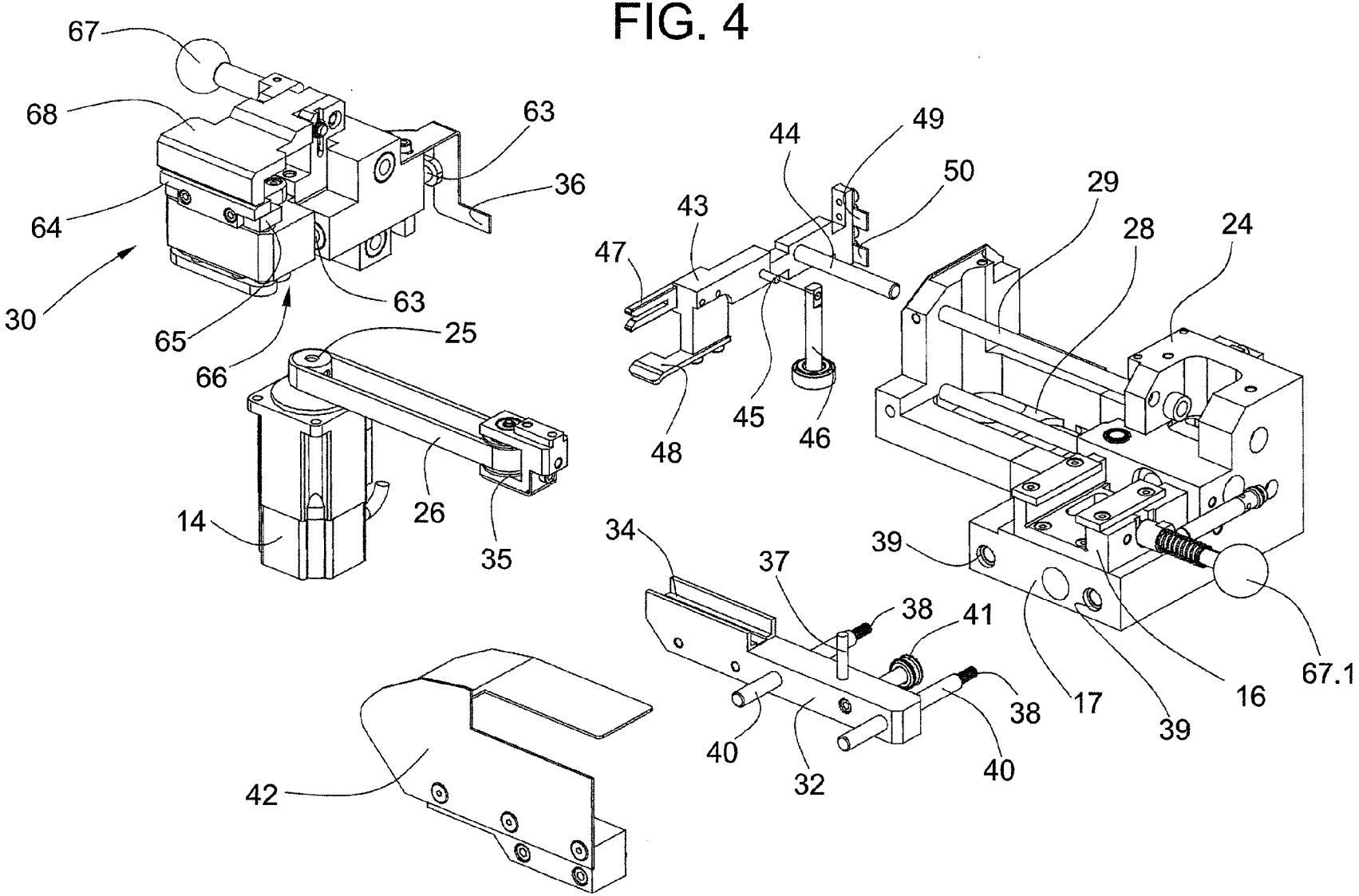
FIG. 4 is an exploded perspective view of the contact advancer shown in FIG. 3.

FIG. 4 shows details of the contact advancer 13. The belt 26 is guided over a second pulley 35, the first carriage 27 being connected to the belt 26 and executing the movement P1. Provided on the first carriage 27 is a first vane 36 that together with a not visible sensor serves to initialize the position of the carriage. The position of the second carriage 32 relative to the first carriage 27, and therefore the distance of the gripper 30 from the first carriage 27, is determined by means of a first pin 37 that is positioned on insertion of the exchangeable anvil part 15 into the contact advancer 13. First springs 38 rest in first drilled holes 39 on the supporting part 17 and by means of second pins 40 bring the second carriage 32 into the starting position. After the first pin 37 is positioned and the anvil part 15 is locked by means of a knob 67.1, a first actuator 41 is actuated which locks the position of the first carriage 32. A housing 42 covers the first carriage 27. Provided to open and close a belt guide that is arranged on the anvil part 15 is a first lever 43 that can be turned about a first swivel axle 44 that is arranged on the housing 24. A second actuator 46 that engages with a third pin 45 turns the first lever 43, a first fork 47 and a feeler 48 being thereby moved. Provided on the first lever 43 are a second vane 49 and a third vane 50 that together with not visible sensors serve to monitor the contact belt 12 and the crimp contacts 19, the second vane 49 monitoring the presence of the contact belt 12 and the third vane 50 monitoring the complete closing of a belt holder 56 (FIG. 6) and therefore the position of the crimp contacts 19.

The gripper 30 consists essentially of a second pressure plate 64 and a first opposing plate 65, the second pressure plate 64 being actuable by means of a third not visible actuator 66 via not visible rods. Held against the second pressure plate 64 by means of a first knob 67 is a stopper plate 68 that can be manually swiveled away.

Figure 5:
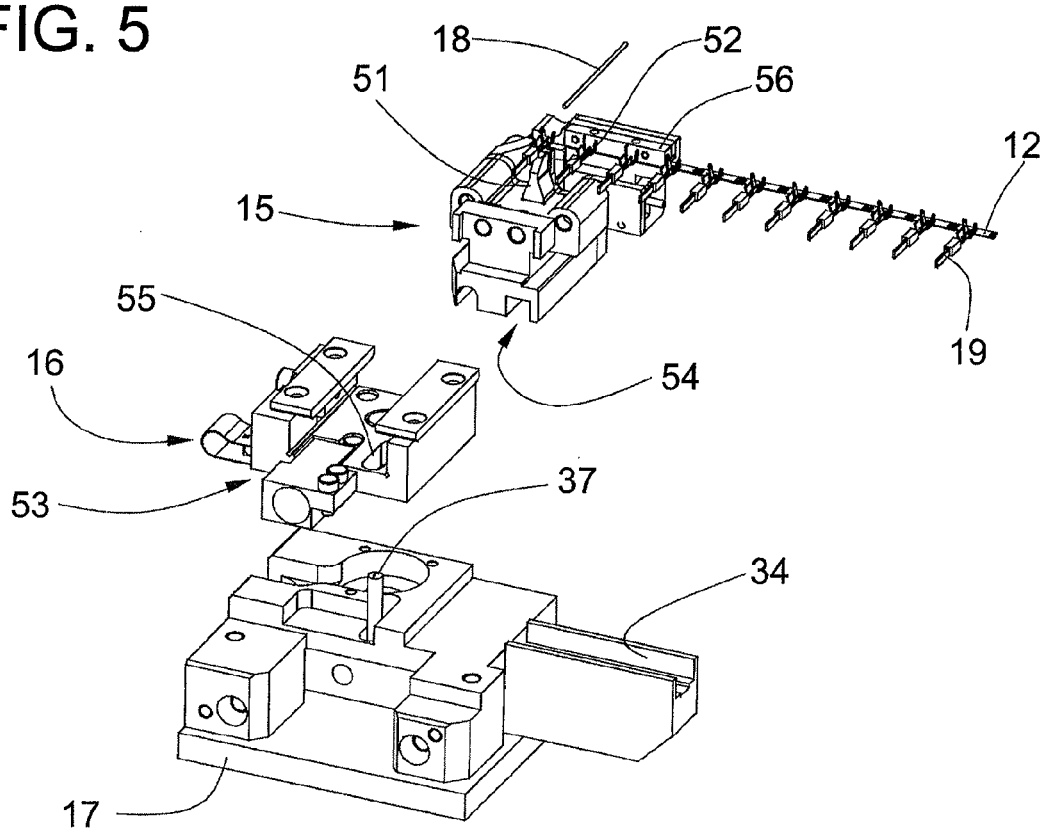
FIG. 5 is an exploded perspective view of the lower tool shown in FIG. 1.

FIG. 5 shows details of the lower tool 11 with the anvil part 15, the sensor part 16, and the first supporting part 17. Arranged on the exchangeable anvil part 15 are a conductor anvil 51 and an insulation anvil 52. Arranged on the sensor part 16 is a force sensor 53 on which the force that arises in the conductor anvil 51 acts, the force sensor 53 in turn being supported on the first supporting part 17. The first supporting part 17 itself is part of the housing 24. Provided on the exchangeable anvil part 15 is a settable first stop 54 which, on insertion of the anvil part 15 into the sensor part 16, actuates the first pin 37 and thereby positions the second carriage 32 and therefore also the gripper 30 in the crosswise direction P2. The first pin 37 penetrates a first opening 55 of the sensor part 16 and extends as far as the travel of the first stop 54. The first stop 54 is set independent of the width of the contact belt 12.

Figure 6:
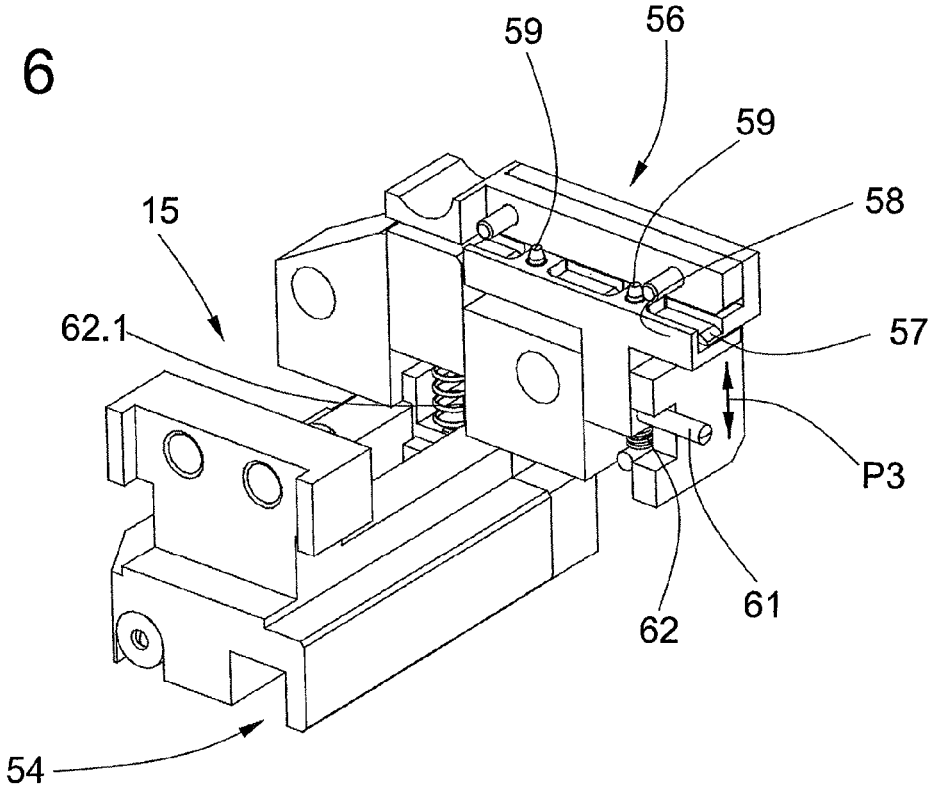
FIG. 6 is a perspective view of the exchangeable anvil part shown in FIG. 1.

FIG. 6 shows details of the exchangeable anvil part 15 with the belt holder 56. The anvil part 15 including the belt holder 56 is an exchangeable part and only fits one type of contact belt or one type of crimp contact and is executed crimp-contact specifically. The belt holder consists essentially of a guide track 57 that guides the contact belt 12 and of a first pressure plate 58 with first pins 59. The first pins 59 fit into transport holes 60 (FIG. 3) of the contact belt, there being provided for each crimp contact 19 one transport hole 60. By means of a fourth pin 61, the first pressure plate 58 can be actuated in the direction indicated by a third arrow P3 against a force of a second spring 62. In the position shown, the first pins 59 penetrate the transport holes 60 from below. The fourth pin 61 can be actuated either by means of the fork 47 or manually by means of the feeler 48. The belt holder 56 is in contact with a not shown contact separator blade, the contact separator blade being lowered from an upper tool during the crimping process and the belt holder 56 being thereby lowered against the spring force of a third spring 62.1 and the crimp contact 19 being thereby separated from the contact belt 12 and simultaneously cutting off the rest of the contact belt.

Advancing of the contact belt 12 takes place by means of the gripper 30, which holds the contact belt 12 tightly between the second pressure plate 64 and the first opposing plate 65 and advances with the movement P1 of the advancing motor 14, while the first pressure plate 58 is actuated and is in the lower position and the first pins 59 have been removed from the guide track 57. After the advance, the first pressure plate 58 is moved upward and the first pins 59 are pushed into the transport holes 60. The gripper 30 is then opened and the second pressure plate 64 is lowered and the first carriage 27 is withdrawn in the direction P1 by means of the advancing motor 14. The gripper 30 is then closed again and the contact belt 12 is held tightly. Before the contact belt 12 is advanced, the first pressure plate 58 is again moved downward and the guide track 57 released from the first pins 59. Independent of the distance between the transport holes and independent of the width of the contact belt 12, controlled by software the gripper 30 advances the contact belt 12 by exactly the space of one contact or of one transport hole distance. After advancement is complete, the first pins 59 are moved upward. A sensor monitors whether the first pins 59 engage in the transport holes 60 and hold the contact belt 12 tight. The gripper 30 is then opened and withdrawn.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A crimping press for fastening belted crimp contacts to wires by crimpers and an exchangeable anvil part, comprising:

a contact advancer advancing a contact belt that carries the crimp contacts as far as the exchangeable anvil part;

said contact advancer including a gripper that is independent of a transport hole distance and of a width of the contact belt and that advances the contact belt as far as the exchangeable anvil part; and a belt holder for holding the contact belt tight on the exchangeable anvil part, said belt holder having a guide track for the contact belt and a first actuable pressure plate with first pins, said first pins fitting transport holes of the contact belt.

2. The crimping press according to claim 1 wherein said belt holder guides the contact belt.

3. The crimping press according to claim 1 wherein said gripper is positionable by the exchangeable anvil part in a crosswise direction to a direction of advance of the contact belt.

4. The crimping press according to claim 1 wherein said gripper is arranged movably on a first carriage that is movable in a direction of advance of the contact belt, and can be moved in a direction crosswise to the advance direction by a second carriage that is arranged on said first carriage.

5. The crimping press according to claim 4 wherein the exchangeable anvil part has a first stop that upon insertion of the exchangeable anvil part into said contact advancer actuates a first pin of said second carriage and positions said gripper on the contact belt in a direction crosswise to the direction of advance of the contact belt.

6. The crimping press according to claim 4 wherein for the purpose of holding the contact belt fast, said gripper has a first plate opposed by a second pressure plate that is actuable by an actuator.

7. The crimping press according to claim 1 wherein said first pressure plate is actuable by a first swiveling lever, a lever fork moving another pin of said first pressure plate in a direction of actuation and lifting said first pins into said guide track or out of said guide track.

8. A crimping press for fastening belted crimp contacts to wires by crimpers and an exchangeable anvil part, comprising:

a contact advancer advancing a contact belt that carries the crimp contacts as far as the exchangeable anvil part;

said contact advancer including a gripper that holds the contact belt, is independent of a transport hole distance and of a width of the contact belt and that advances the contact belt as far as the exchangeable anvil part in a first positioning movement relative to the exchangeable anvil part; and a belt holder for holding the contact belt tight on the exchangeable anvil part, said belt holder engaging the contact belt upon movement of the contact belt to the exchangeable anvil part by said gripper, and said gripper releasing the contact belt upon engagement of the contact belt by said belt holder thereby permitting a fine second positioning movement in the exchangeable anvil part, wherein said belt holder has a guide track for the contact belt and a first actuable pressure plate with first pins, said first pins fitting transport holes of the contact belt.

9. The crimping press according to claim 8 wherein said belt holder guides the contact belt.

10. The crimping press according to claim 8 wherein said gripper is positionable by the exchangeable anvil part in a crosswise direction to a direction of advance of the contact belt.

11. The crimping press according to claim 8 wherein said gripper is arranged movably on a first carriage that is movable in a direction of advance of the contact belt, and can be moved in a direction crosswise to the advance direction by a second carriage that is arranged on said first carriage.

12. The crimping press according to claim 11 wherein the exchangeable anvil part has a first stop that upon insertion of the exchangeable anvil part into said contact advancer actuates a first pin of said second carriage and positions said gripper on the contact belt in a direction crosswise to the direction of advance of the contact belt.

13. The crimping press according to claim 8 wherein for the purpose of holding the contact belt fast, said gripper has a first plate opposed by a second pressure plate that is actuable by an actuator.

14. The crimping press according to claim 8 wherein said first pressure plate is actuable by a first swiveling lever, a lever fork moving another pin of said first pressure plate in a direction of actuation and lifting said first pins into said guide track or out of said guide track.

* * * * *